US005396474A

United States Patent [19]

Lin

[11] Patent Number: 5,396,474

[45] Date of Patent: Mar. 7, 1995

[54] CLOCK ASSEMBLY

[76] Inventor: Jay Lin, No. 26, Long Yen Rd., Chang Hua City, Taiwan, Prov. of China

[21] Appl. No.: 54,593

[22] Filed: Apr. 29, 1993

[51] Int. Cl.[6] ..... G04B 37/00

[52] U.S. Cl. ..... 368/228; 223/88

[58] Field of Search ..... 368/223-228, 368/229-239, 276-285, 76, 80, 88

[56] References Cited

U.S. PATENT DOCUMENTS

| | | | |
|---|---|---|---|
| 366,683 | 7/1887 | Pennington | 368/88 |
| 1,815,465 | 6/1931 | Fantel | 368/261 |
| 4,277,842 | 7/1981 | Richards | 368/282 |
| 4,624,579 | 11/1986 | Forman | 368/88 |
| 4,718,773 | 1/1988 | O'Donoghue | 368/276 |
| 4,769,799 | 9/1988 | Matsukage | 368/278 |
| 5,216,642 | 6/1993 | Rikkers | 368/10 |

FOREIGN PATENT DOCUMENTS 887680 5/1959 United Kingdom .

*Primary Examiner*—Bernard Roskoski

*Attorney, Agent, or Firm*—Wolf, Greenfield & Sacks

[57] ABSTRACT

A clock includes an inner frame, an outer frame, a sheet material clamped between the inner frame and the outer frame, and a clock mechanism fixed to the sheet material. The clock mechanism includes a shaft extended through the sheet material and two or more pointers secured to the shaft. Various kinds of patterns can be formed on the sheet material.

5 Claims, 2 Drawing Sheets

CLOCK ASSEMBLY

BACKGROUND OF THE INVENTION

1. Field of the Invention

The present invention relates to a clock assembly, and more particularly to a clock assembly having a novel configuration.

2. Description of the Prior Art

Typical clocks include a clock mechanism disposed in a housing which lacks changeablility. Normally, the clocks comprise a complicated configuration which is adverse for maintenance purposes.

The present invention has arisen to mitigate and/or obviate the afore-described disadvantages of the conventional clocks.

SUMMARY OF THE INVENTION

The primary objective of the present invention is to provide a clock assembly which includes a novel configuration.

In accordance with one aspect of the invention, there is provided a clock assembly comprising an inner free, an outer free, a sheet material clamped between the inner frame and the outer frame, a hole formed in a middle portion of the sheet material, a clock body including a shaft extended through the hole of the sheet material, and at least two pointers secured to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
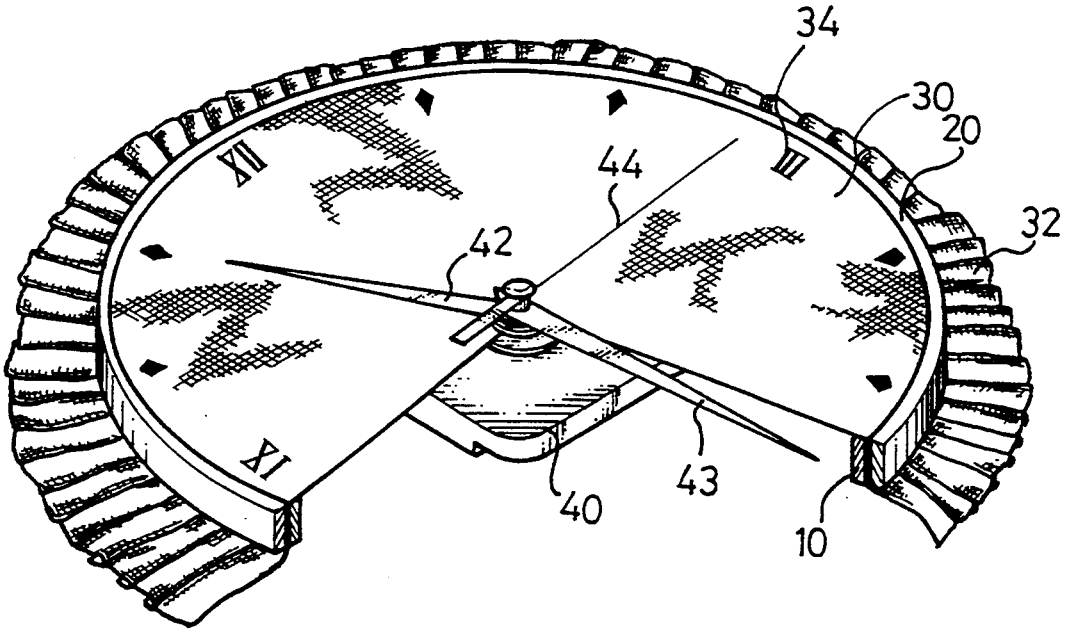
FIG. 1 is a perspective view of a clock assembly in accordance with the present invention, in which for clearly showing the interior of the clock assembly, part of the clock assembly is cut off.
Figure 2:
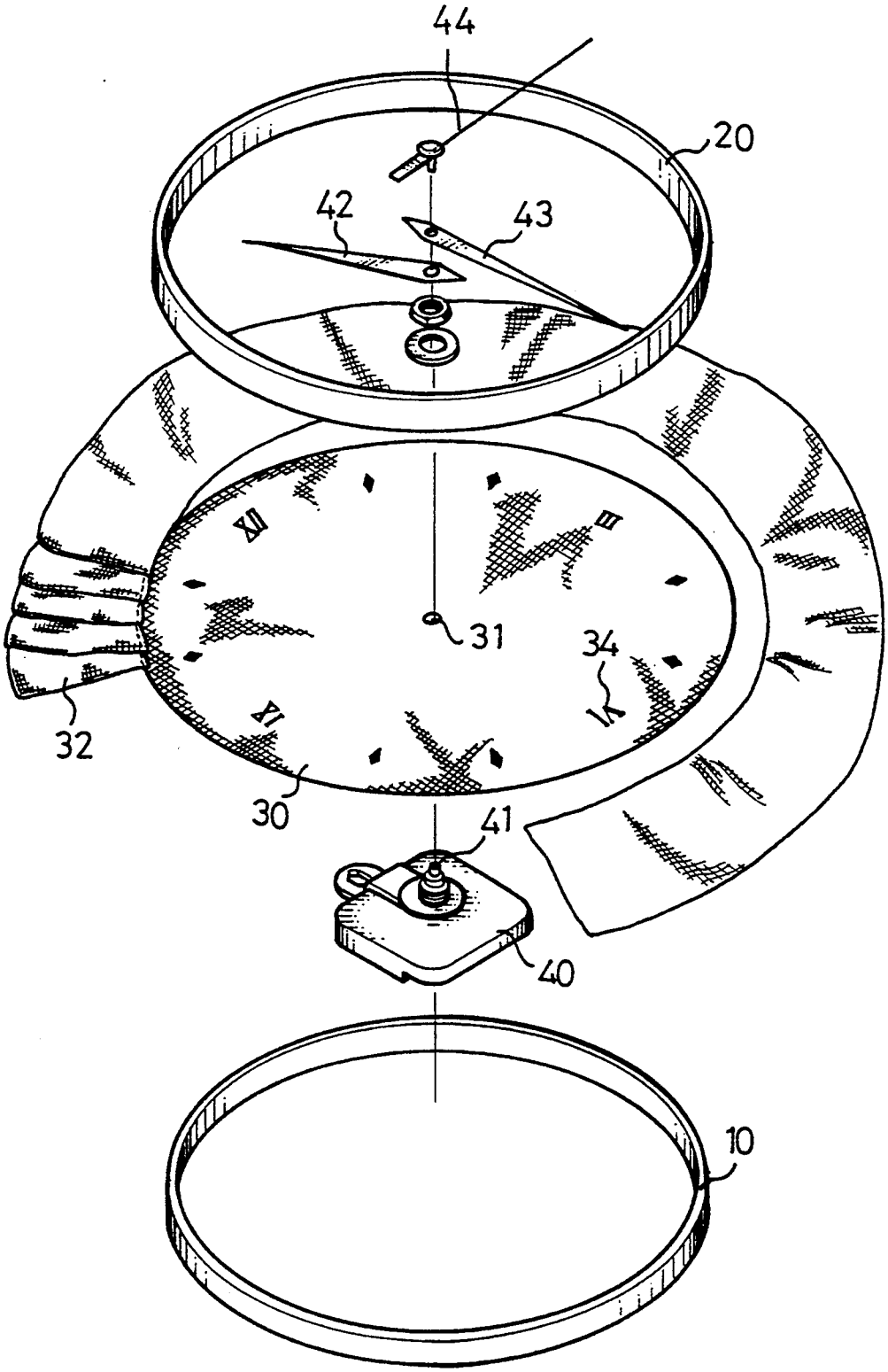
FIG. 2 is an exploded view of the clock assembly.

Referring to the drawings, a clock assembly in accordance with the present invention comprises an inner frame 10, an outer frame 20 having a diameter larger than that of the inner frame 10 and engageable on the outer portion of the inner frame 10, a layer of sheet material 30, such as fabric materials, fixed between the frames 10, 20 and stretched by the frames 10, 20 such that the middle portion of the sheet material 30 forms a flat surface, a hole 31 formed in the center of the sheet material 30, a clock body 40 including a shaft 41 extended upward through the hole 31 of the sheet material 30, and three pointers 42, 43, 44 attached to the shaft 41 of the clock body 40, whereby, a novel clock is formed. It is preferable that an annular lace material 32 is secured to the peripheral portion of the sheet material 30. The sheet material 30 includes a number of numerals 34 provided thereon for indicating the positions of the pointers 42, 43, 44 so as to indicate the time of the clock assembly.

It is to be noted that, though the frames 10, 20 are circular as shown in the drawings, the frames can be made with various kinds of shapes, such as square, rectangular, oval, etc.

Alternatively, the sheet material 30 of the clock assembly may be made of other materials, such as paper materials, plastic materials, plastic films etc.

Accordingly, the clock assembly in accordance with the present invention includes a novel configuration which is simple and can be made easily, such that the manufacturing cost thereof is greatly reduced. In addition, various kinds of patterns can be printed on the sheet material 30, for example, for advertising purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clock assembly comprising an inner frame, an outer frame, a flexible sheet material clamped between said inner frame and said outer frame, said flexible sheet material being stretched between said inner and outer frames so as to form a substantially flat clock face, said sheet material including an annular lace material extending from said inner frame and said outer frame, a hole formed in a middle portion of said sheet material defining said flat clock face, a clock body including a shaft extended through said hole of said sheet material, and at least two pointers secured to said shaft.

2. The clock assembly as claimed in claim 1, wherein the sheet material is a fabric.

3. A clock assembly as claimed in claim 1, wherein the sheet material is paper.

4. The clock assembly as claimed in claim 1, wherein the sheet material is plastic.

5. A clock assembly as claimed in claim 1, wherein the sheet materials has numerals provided thereon.

* * * * *